United States Patent [19]

Fitzgerald et al.

[11] 4,367,764

[45] Jan. 11, 1983

[54] BY-PASS VALVE IMPROVEMENT

[75] Inventors: John B. Fitzgerald, St. Louis, Mo.; George L. York, Belleville, Ill.

[73] Assignee: ACF Industries, Inc., New York, N.Y.

[21] Appl. No.: 257,464

[22] Filed: Apr. 24, 1981

[51] Int. Cl.[3] ..... F16K 31/126

[52] U.S. Cl. ..... 137/115; 60/290; 137/543.15; 137/869; 137/871; 137/DIG. 8

[58] Field of Search ..... 60/290; 137/115, 543.15, 137/869, 871, DIG. 8

[56] References Cited

U.S. PATENT DOCUMENTS 2,810,397 10/1957 Olson et al. ..... 137/543.15 X 3,964,515 6/1976 May ..... 60/290 X

*Primary Examiner*—Gerald A. Michalsky

*Attorney, Agent, or Firm*—J. Joseph Muller

[57] ABSTRACT

An air by-pass valve (1) has an air inlet (5), an air outlet (7), a relief port (11), and a relief valve (37) responsive to excessive air pressure for opening the relief port and dumping air to atmosphere. The relief valve comprises a valve member (39) mounted on a stem (23) and movable relative thereto. One side of the valve member is acted on by a spring (41) biasing the valve member to close the relief port. Air pressure acts on the opposite side of the valve member to move the valve member against the spring and open the relief port. The side of the valve member against which the spring acts is contoured so the spring force is unevenly applied to the valve member over the surface on which the spring acts. Uneven application of this force causes the valve member to cock against the stem when moved from its relief port closing position by excessive air pressure whereby air flow around the valve member is unbalanced thereby reducing relief valve hammer caused by harmonic vibrations induced by air flow around the relief valve member.

10 Claims, 2 Drawing Figures

BY-PASS VALVE IMPROVEMENT

BACKGROUND OF THE INVENTION

This invention relates to valves having a pressure relief and in particular to a relief valve member designed to reduce or eliminate relief valve hammer produced by fluid flow around the valve member.

For several years, air by-pass valves have been used to supply auxiliary air to the exhaust system of an internal combustion engine to aid in reducing pollution. One type by-pass valve used for this purpose is described in U.S. Pat. No. 3,964,515 issued June 22, 1976 and assigned to the same assignee as the present application. One feature of this and similar by-pass valves is a relief valve for dumping air to atmosphere in the event an overpressure condition occurs. The relief valve member, when the relief valve is activated, is subjected to "hammering" caused by harmonic frequencies induced in the valve member by air rushing around the valve. Such hammering increases valve member wear thus shortening the useful life of the by-pass valve.

SUMMARY OF THE INVENTION

Among the several objects of the present invention may be noted the provision of an improved by-pass valve incorporating pressure relief; the provision of such an improvement for increasing the useful life of the pressure relief valve by eliminating relief valve hammer caused by movement of air around the relief valve member when the relief valve is open; the provision of such an improvement for eliminating relief valve hammer by applying bias forces unevenly on the relief valve member; and the provision of such an improvement which does not interfere with normal operation of the by-pass valve.

Briefly, the improvement of the present invention is to an air by-pass valve having an air inlet, an air outlet, a relief port, and a relief valve responsive to excessive air pressure for opening the relief port and dumping air to atmosphere. The improvement comprises a relief valve member mounted on a stem and movable relative thereto. One side of the valve member is acted on by a spring biasing the valve member to close the relief port. Air pressure acts on the opposite side of the valve member to move the valve member against the spring and open the relief port. The side of the valve member against which the spring acts is contoured so the spring force is unevenly applied to the valve member over the surface on which the spring acts. Uneven application of this force causes the valve member to cock against the stem when moved from its relief port closing position by excessive air pressure. Thus, air flow around the valve member is unbalanced thereby reducing relief valve hammer caused by harmonic vibrations induced by air flow around the relief valve member. Other objects and features will be in part apparent and in part pointed out hereinafter.

BRIEF DESCRIPTION OF THE DRAWINGS

Corresponding reference characters indicate corresponding parts in the drawings.

DESCRIPTION OF A PREFERRED EMBODIMENT

Figure 1:
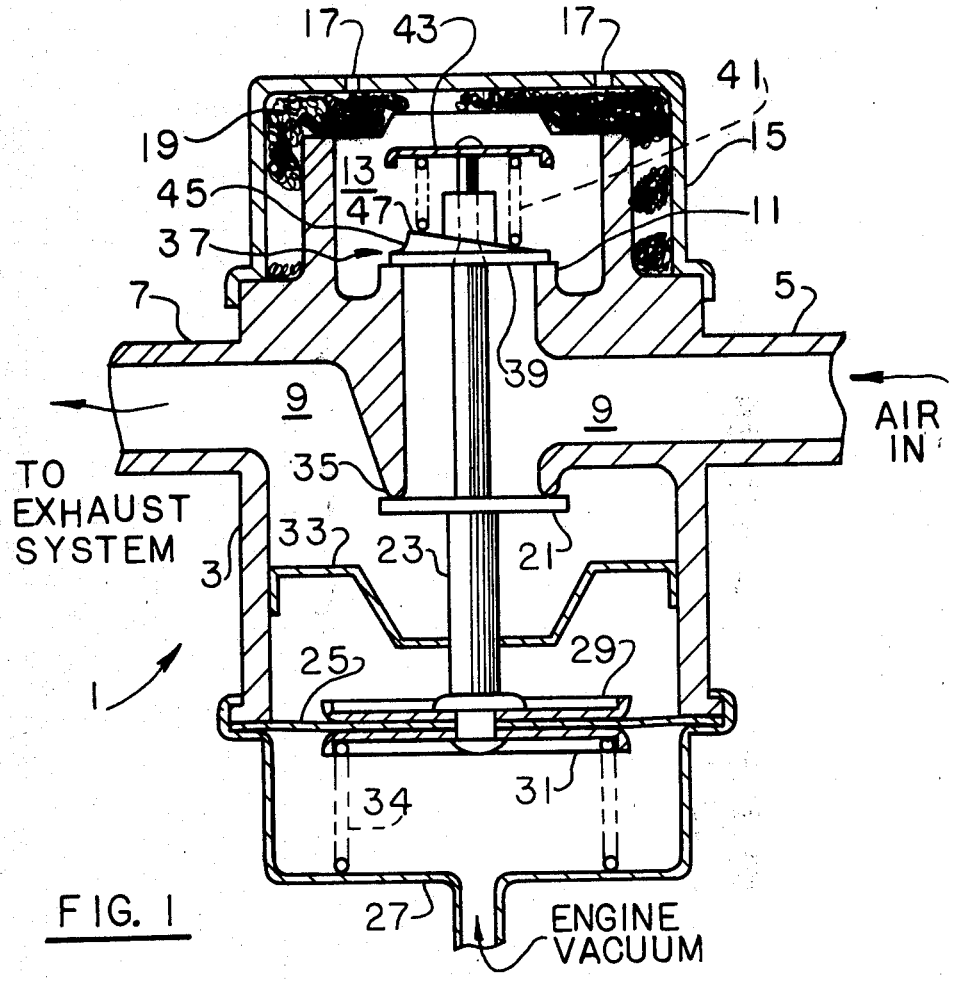
FIG. 1 is a sectional view of an air by-pass valve illustrating the improvement of the present invention to the pressure relief valve portion of the by-pass valve.

Referring to the drawings, an air by-pass valve 1 comprises a valve body 3 in which is formed an air inlet 5, an air outlet 7, a passage 9 between the inlet and outlet and a relief port 11. A relief chamber 13 is formed above the relief port and is enclosed by a cover 15 having one or more holes 17 through which air escapes to the atmosphere. A muffler material 19 is used to deaden the noise caused by the rush of air through the relief port. A control valve 21 controls movement of air between the inlet and outlet. The control valve is mounted on a stem 23 one end of which is attached to a flexible diaphragm 25. The outer margin of the diaphragm is clamped between the lower end of valve body 3 and an end cap 27. The diaphragm is sandwiched between a pair of backing plates, 29 and 31 respectively, and an annular separator 33 positioned above the diaphragm assembly acts as a guide for stem 23. A bias spring 34 urges the diaphragm assembly upwardly to seat control valve 21 against a port 35 and block flow of air between inlet 5 and outlet 7.

Air by-pass valve 1 is typically used to direct air to the exhaust system (not shown) of an internal combustion engine (also not shown). The underside of diaphragm 25 is subjected to engine manifold vacuum to pull the diaphragm down against the force of spring 34 and move control valve 21 away from port 35 to open the port and permit air from inlet 5 to flow to outlet 7 through passage 9. By-pass valve 1 also includes a relief valve 37 responsive to excessive air pressure for opening relief port 11 so air can be dumped to the atmosphere.

In the improvement of the present invention, relief valve 37 comprises a relief valve member 39 mounted on stem 23 and movable relative thereto. One side of valve member 39 is acted on by a bias spring 41 which seats against a spring retainer 43 attached to the upper end of stem 23. The opposite or underside of valve member 39 is acted on by air pressure to move the valve member against the force of spring 41 and open relief port 11. As is well understood in the art, pressure relief valve 37 may be activated at any time when an overpressure condition occurs regardless of whether port 35 is open or closed.

The side or face of valve member 39 against which spring 41 acts is contoured so the spring force is unevenly applied to the valve member over the surface on which the spring acts. The upper face of valve member 39 has a shoulder 45 with a sloping spring bearing surface 47. Thus, one portion of shoulder 45 is higher than another portion thereof and this causes the spring forces to be unbalanced about the circumference of the valve member. Preferably, sloping surface 47 is an inclined plane.

Figure 2:
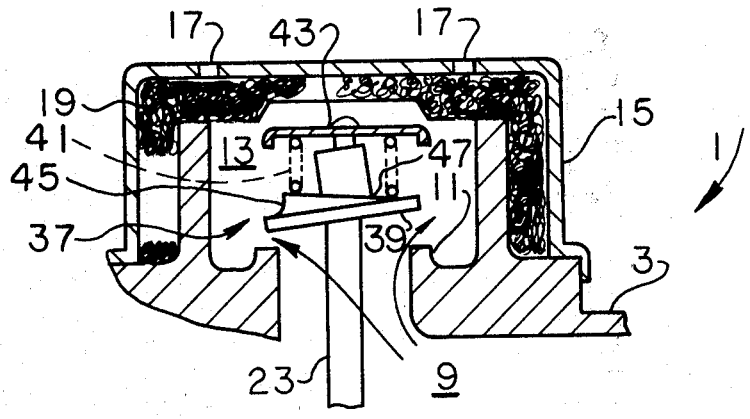
FIG. 2 is a sectional view of a portion of the by-pass valve of FIG. 1 illustrating how the improvement of the present invention eliminates relief valve hammer when the relief valve is open.

Referring to FIG. 2, the effect produced by having valve member 39 have a sloping spring contact surface is shown. When excessive air pressure unseats valve member 39 against the force of spring 41, the valve member is cocked or canted against stem 23. The air flow around the valve member is unbalanced or uneven and this together with the increased friction created between the valve member and stem substantially eliminates "hammering". This phenomenon is caused by harmonic vibrations induced in the valve member by flow of air around the valve, and this hammering greatly increases relief valve wear and shortens the useful life of the by-pass valve. Elimination of "hammering" due to the factors mentioned above lessens wear on the relief valve member thereby increasing durability. At the same time, normal functioning of the by-pass valve is unimpaired.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In an air by-pass valve having an air inlet, and air outlet, a relief port, and a relief valve responsive to excessive air pressure for opening the relief port and dumping air to atmosphere, the improvement wherein the relief valve comprises a valve member mounted on a stem and movable relative thereto, one side of the valve member being acted on by a spring biasing the valve member to close the relief port and air pressure acting on the opposite side of the valve member to move the valve member against the spring and open the relief port, the side of the valve member against which the spring acts being contoured so the spring force is unevenly applied to the valve member over the surface on which the spring acts, uneven application of this force causing the valve member to cock against the stem when the valve member is moved from its relief port closing position by excessive air pressure whereby air flow around the valve member is unbalanced thereby reducing relief valve hammer caused by harmonic vibrations induced by air flow around the relief valve member.

2. The improvement of claim 1 wherein the valve member has a shoulder on its one side against which one end of the spring bears, the shoulder having a sloping surface with one portion of the shoulder being higher than another portion thereof whereby the force exerted on the valve member by the spring is unbalanced about the circumference of the valve member.

3. The improvement of claim 2 wherein the surface of the shoulder against which the spring bears is an inclined plane.

4. In a valve having a fluid inlet, a fluid outlet, a fluid relief port and a relief valve responsive to excessive fluid pressure for opening the relief port for escape of fluid therethrough, the improvement wherein the relief valve comprises a valve member one side of which is acted on by a spring for biasing the valve member to close the relief port, the side of the valve member against which the spring acts being contoured so the spring force is unevenly applied to the valve member over the surface on which the spring acts.

5. The improvement of claim 4 wherein the valve member is mounted on a stem and movable relative thereto, the uneven application of spring forces on the one side of the valve member causing the valve member to cock against the stem when moved from its relief port closing position by excessive fluid pressure whereby fluid flow around the valve member is unbalanced thereby reducing relief valve hammer caused by harmonic vibrations induced by fluid flow around the valve member.

6. The improvement of claim 5 wherein the valve member has a shoulder on its one side against which one end of the spring bears, the shoulder having a sloping surface so one portion of the shoulder is higher than another portion thereof, the sloping surface causing spring forces to be unevenly applied to the valve member about the circumference thereof.

7. The improvement of claim 6 wherein the surface of the shoulder against which the spring bears is an inclined plane.

8. In an air by-pass valve for use in directing air to the exhaust system of an internal combustion engine, the by-pass valve having an air inlet, at least one air outlet, a relief port for dumping air to atmosphere, a relief chamber through which air passing through the relief port is directed to the atmosphere, a relief valve responsive to excessive air pressure for opening the relief port for air to escape therethrough, a control valve for controlling movement of air between the inlet and outlet, a stem on which the control valve is mounted and a diaphragm to which one end of the stem is attached, the diaphragm being responsive to engine vacuum for moving the stem and the control valve, the improvement comprising a relief valve member mounted on the stem and movable relative thereto, one side of the valve member being acted on by a spring biasing the valve member to close the relief port and air pressure acting on the opposite side of the valve member to move the valve member against the force of the spring and open the relief port, the side of the valve member against which the spring acts being so contoured that the spring force is unevenly applied to the valve member over the surface on which the spring acts, uneven application of this force causing the valve member to cock against the stem when the valve member is moved from its relief port closing position by excessive air pressure whereby air flow around the valve member is unbalanced thereby reducing relief valve hammer caused by harmonic vibrations induced by air flow around the valve member.

9. The improvement of claim 8 wherein the valve member has a shoulder on its one side against which one end of the spring bears, the shoulder having a sloping surface with one portion of the shoulder being higher than another portion thereof whereby the force exerted on the valve member by the spring is unbalanced about the circumference of the valve member.

10. The improvement of claim 9 wherein the surface of the shoulder against which the spring bears is an inclined plane.

* * * * *